US009751736B1

(12) United States Patent
Fortin

(10) Patent No.: US 9,751,736 B1
(45) Date of Patent: Sep. 5, 2017

(54) MANUAL VEHICLE RAMP JACK WITH AUXILIARY HYDRAULIC JACK

(71) Applicant: Michael Fortin, New Bedford, MA (US)

(72) Inventor: Michael Fortin, New Bedford, MA (US)

( * ) Notice: Subject to any disclaimer, the term of this patent is extended or adjusted under 35 U.S.C. 154(b) by 0 days.

(21) Appl. No.: 15/138,506

(22) Filed: Apr. 26, 2016

(51) Int. Cl.
*B66F 3/25* (2006.01)
*B66F 7/24* (2006.01)

(52) U.S. Cl.
CPC ..... *B66F 3/25* (2013.01); *B66F 7/243* (2013.01); *B66F 2700/052* (2013.01)

(58) Field of Classification Search
None
See application file for complete search history.

(56) References Cited

U.S. PATENT DOCUMENTS 3,804,206 A 4/1974 Bubik
4,445,665 A 5/1984 Cray
6,045,122 A * 4/2000 Torres ..... B66F 7/0608 254/122
8,695,942 B2 4/2014 Dawes
2003/0160221 A1* 8/2003 Dunbar, Sr. ..... B66F 3/30 254/88
2015/0076431 A1* 3/2015 Kritzer ..... B66F 5/04 254/89 H

* cited by examiner

*Primary Examiner* — Joseph J Hail
*Assistant Examiner* — Brian Keller
(74) *Attorney, Agent, or Firm* — Stevenson IP, LLC

(57) ABSTRACT

A manual vehicle ramp jack with an auxiliary hydraulic jack including a pair of parallel tire ramps and a lifter base disposed on the front end of each tire ramp, which has a riser plate movably disposed within a central aperture thereof from a lowered, recessed condition to an alternate raised condition. Each riser plate is provided to receive a tire therein. A manually operated mechanical foot jack is in operational communication and a mechanical hydraulic toe jack is in alternate operational communication with the riser plate of each lifter base. A foot-depressible crossbeam operationally connects the foot jacks together which permits the foot jacks to be operated simultaneously.

4 Claims, 6 Drawing Sheets

MANUAL VEHICLE RAMP JACK WITH AUXILIARY HYDRAULIC JACK

BACKGROUND OF THE INVENTION

Various types of vehicle tire jacks are known in the prior art. However, in contrast to previously known vehicle tire jacks, the present manual vehicle ramp jack with an auxiliary hydraulic jack provides a pair of tire ramps and a lifter base attached to a front end of each tire ramp and permits the lifting of both tires simultaneously with a foot-depressible crossmember operationally connecting a pair of manually operated mechanical foot jacks disposed within their respective lifter base and alternately the lifting of the tires individually with a foot-operated hydraulic bottle jack disposed in each lifter base. The hydraulic jack assists in lifting the tires to a height greater than to a height permitted by the manual vehicle ramp jack.

FIELD OF THE INVENTION

The present invention relates to a vehicle tire jack, and more particularly, to a manual vehicle ramp jack with an auxiliary hydraulic jack.

SUMMARY OF THE INVENTION

The general purpose of the present, described subsequently in greater detail, is to provide a manual vehicle ramp jack with an auxiliary hydraulic jack which has many novel features that result in a manual vehicle ramp jack with an auxiliary hydraulic jack which is not anticipated, rendered obvious, suggested, or even implied by prior art, either alone or in combination thereof.

To accomplish this, the present manual vehicle ramp jack with an auxiliary hydraulic jack includes a pair of parallel tire ramps and a lifter base disposed on the front end of each tire ramp. Each lifter base includes a lower side, a substantially open front side having a perimeter-disposed frame and a central opening, a rear side, a right side, a left side, and an upper side. A central aperture is disposed within the upper side. The riser plate is disposed within the central aperture parallel to the lifter base lower side when the riser plate is in a lowered, recessed condition and is alternately disposed outside of the central aperture parallel to the lifter base lower side when the riser plate is in an alternate raised condition. The riser plate has a recessed receptacle sized to receive a tire therein and also has a protruding outer edge that rests on the upper side of the lifter base when the riser plate is in the lowered, recessed condition.

A manually operated mechanical foot jack is in operational communication with the riser plate of each lifter base and with each other. A foot-depressible crossbeam operationally connects the foot jacks together which permits the foot jacks to be operated simultaneously to raise and lower their respective riser plates. A mechanical hydraulic toe jack includes a bottle jack disposed within the respective lifter base and is in alternate operational communication with the riser plate of one of each of a respective lifter base to raise and lower the respective riser plate. The foot jack and the toe jack are alternately configured to lift and alternately lower the riser plate of the respective lifter base.

Thus has been broadly outlined the more important features of the present manual vehicle ramp jack with an auxiliary hydraulic jack so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
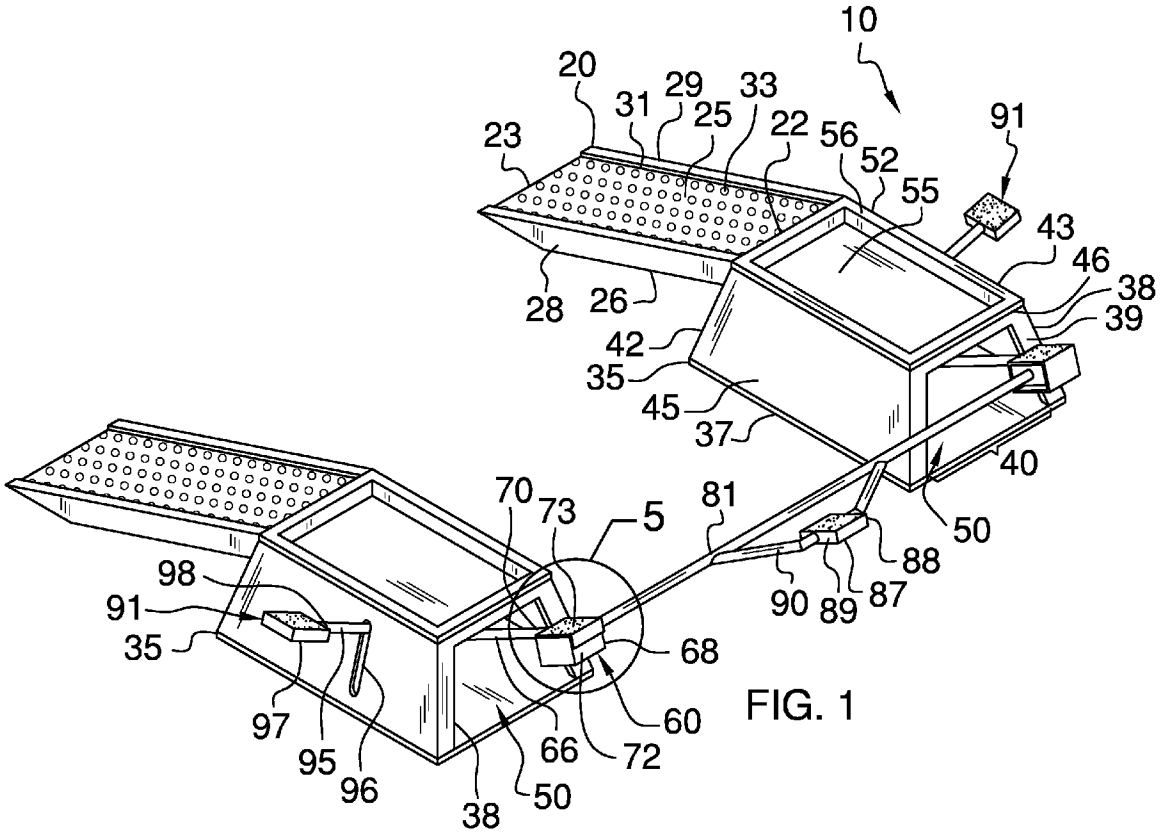
FIG. 1 is a front perspective view.
Figure 2:
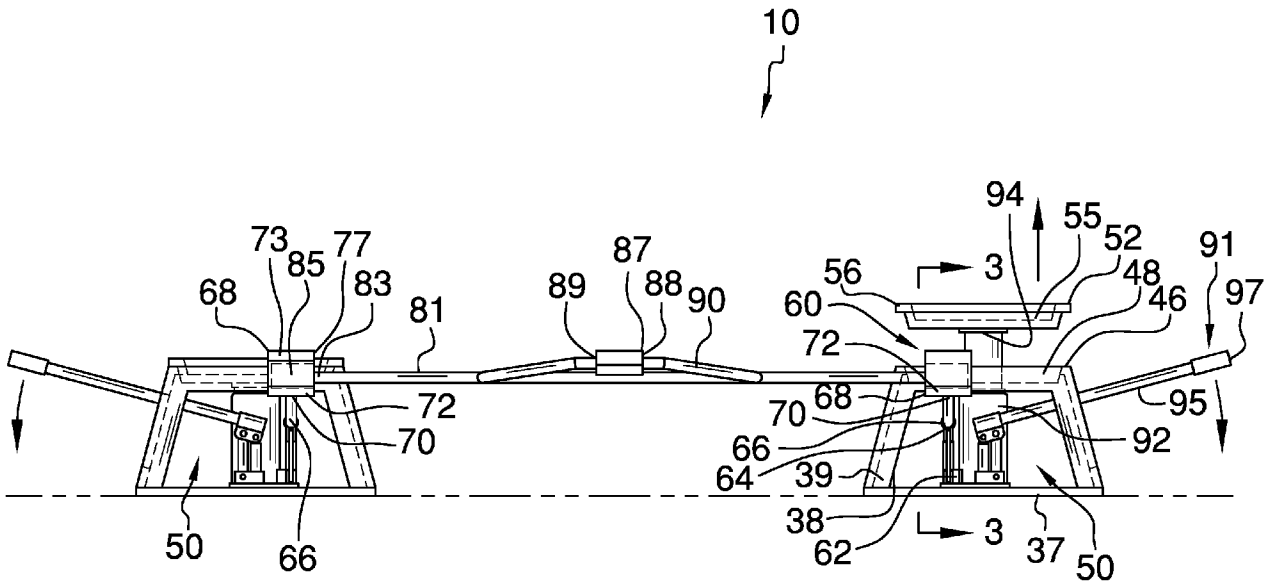
FIG. 2 is a front view.
Figure 3:
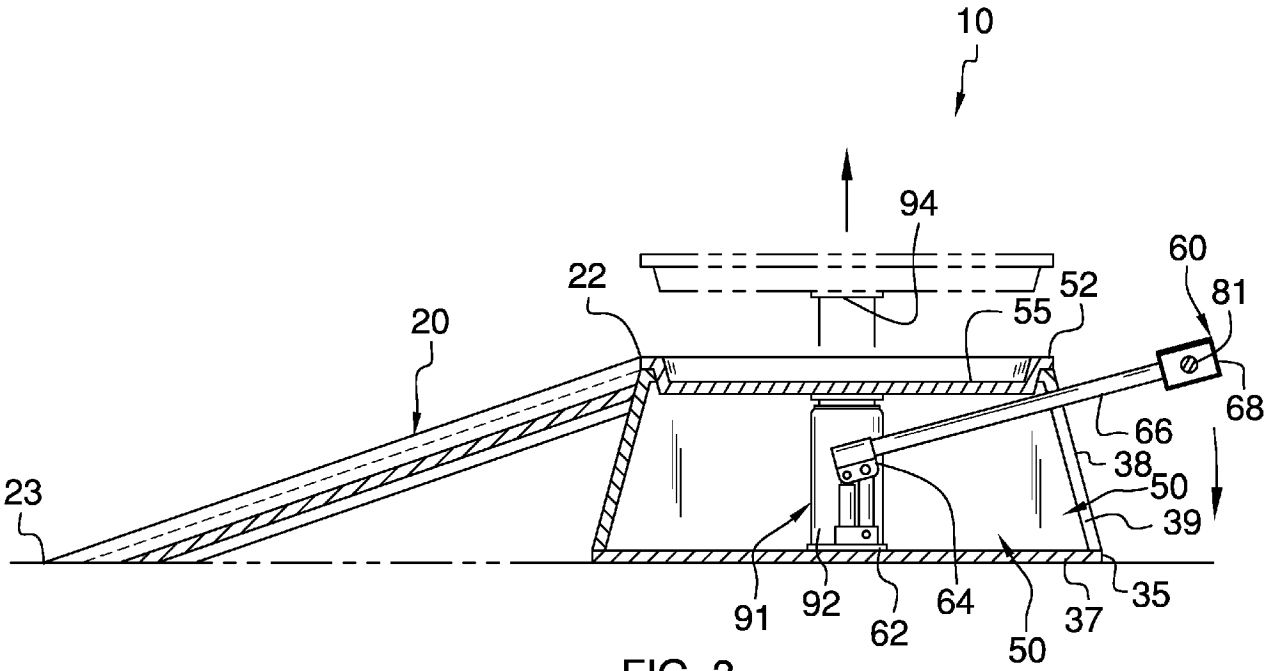
FIG. 3 is a cross-sectional view taken along line 3-3 of FIG. 2.
Figure 4:
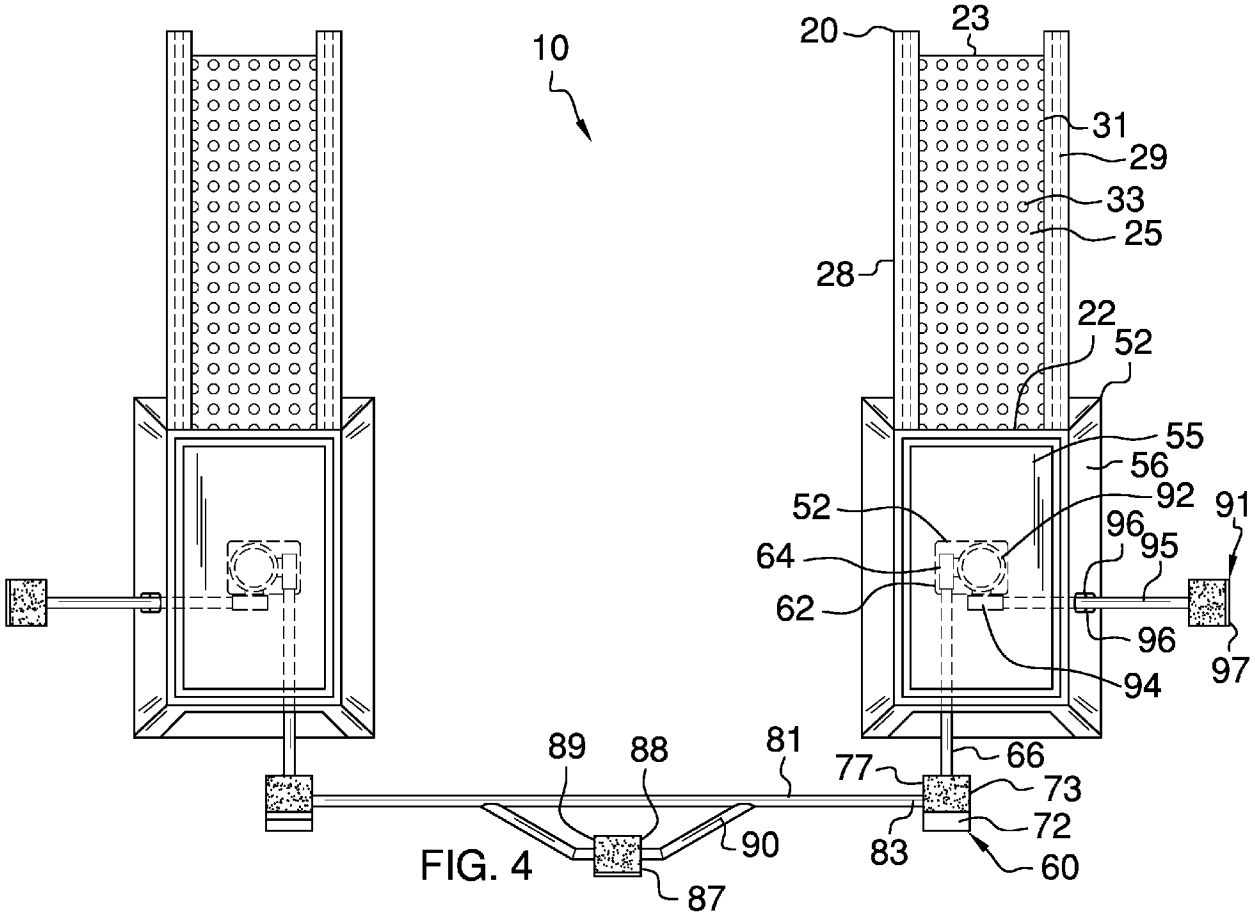
FIG. 4 is a top view.
Figure 5:
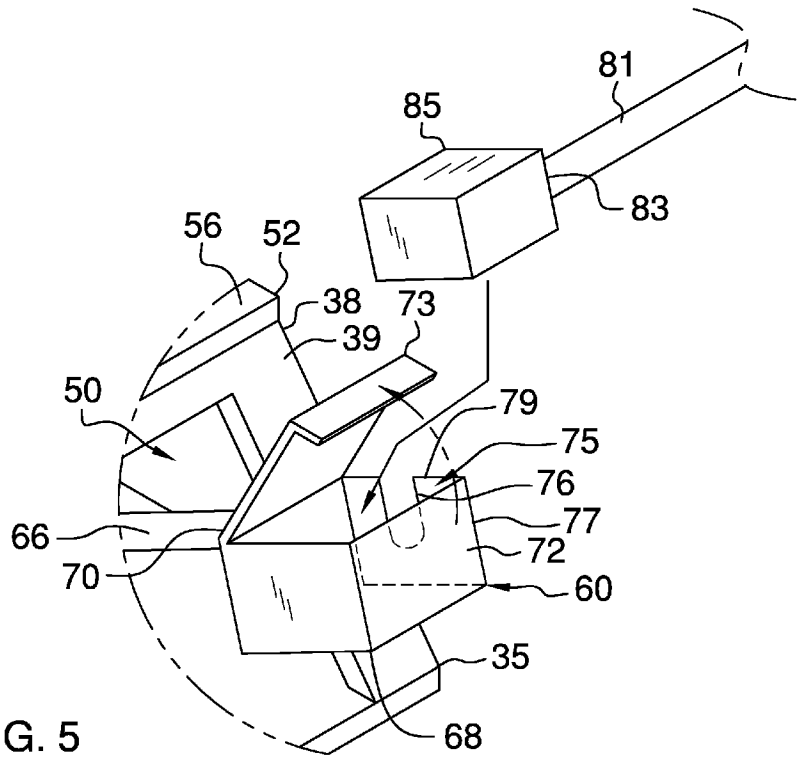
FIG. 5 is a detail view of a manual jack pedal.
Figure 6:
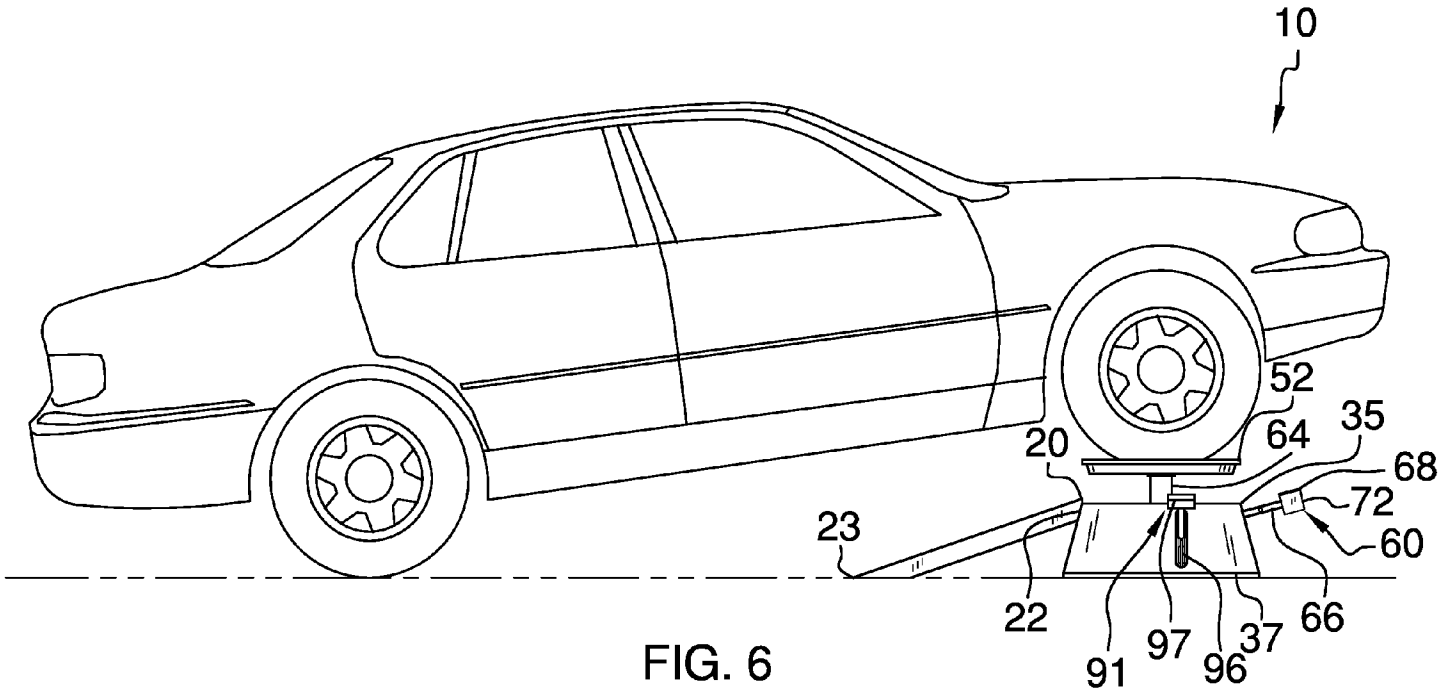
FIG. 6 is an in-use view.

With reference now to the drawings, and in particular FIGS. 1 through 6 thereof, an example of the instant manual vehicle ramp jack with an auxiliary hydraulic jack employing the principles and concepts of the present manual vehicle ramp jack with an auxiliary hydraulic jack and generally designated by the reference number 10 will be described.

Referring to FIGS. 1 through 6 the present manual vehicle ramp jack with an auxiliary hydraulic jack 10 is illustrated. The manual vehicle ramp jack with an auxiliary hydraulic jack 10 includes a pair of parallel tire ramps 20. Each tire ramp 20 has a front end 22, a rear end 23, a top side 25, a bottom side 26, a pair of continuous outer sides 28, and a vertical lip 29 continuously disposed on an upper side 31 of each of the outer sides 28. The top side 26 of each tire ramp 20 has a gripping texture 33.

A lifter base 35 is disposed on the front end 22 of each tire ramp 20. Each lifter base 35 includes a lower side 37, a substantially open front side 38 having a perimeter-disposed frame 39 and a central opening 40, a rear side 42, a right side 43, a left side 45, and an upper side 46. A central aperture 48 is disposed within the upper side 46. An internal compartment 50 is continuously disposed between the lower side 37, the front side 38, the rear side 42, the right side 43, the left side 45, and the upper side 46, and a concave riser plate 52 engaging the central aperture 48. The riser plate 52 is disposed within the central aperture 48 parallel to the lifter base 35 lower side 37 when the riser plate 52 is in a lowered, recessed condition. The riser plate 52 is disposed outside of the central aperture 48 in a position parallel to the lifter base 35 lower side 37 when the riser plate 52 is in an alternate raised condition. The riser plate 52 has a recessed receptacle 55 sized to receive a tire therein and also has a protruding outer edge 56 that rests on the upper side 46 of the lifter base 35 when the riser plate 52 is in the lowered, recessed condition.

A manually operated mechanical foot jack 60 is in operational communication with the riser plate 52 of each lifter base 35 and with each other. Each foot jack 60 includes a footer 62 is disposed on the lower side 37 within the internal compartment 50 of the respective lifter base 35. A lever 64 is disposed atop the footer 62 and has a bar 66 extending through the front side 38 of the lifter base 35. A parallelepiped foot pedal 68 is disposed on an exterior end 70 of the bar 66. Each foot pedal 68 has a forward wall 72, an openable lid 73, an interior cavity 75, and a notch 76 disposed on an internal side 77 thereof. The notch 76 is open on a top edge 79 of the respective foot pedal 68.

The foot jack 60 also includes a crossbeam 81 operationally connecting the foot jacks 60 together which permits that foot jacks 60 to be operated simultaneously. The crossbeam 81 has a pair of outer ends 83. A parallelepiped attachment member 85 is disposed on each of the outer ends 83 of the crossbeam 81. Each outer end 83 of the crossbeam 81 engages the notch 76 of the respective foot pedal 68 and each attachment member 85 securingly engages the interior cavity 75 of the respective foot pedal 68. The crossbeam 81 further has a parallelepiped foot member 87 disposed thereon substantially midway between the lifter bases 35. The foot member 87 has a right wall 88 and a left wall 89 and an arm 90 extending from a respective one of the right wall 88 and the left wall 89 to the crossbeam 81. The foot member 87 is disposed on a same side of the crossbeam 81 as the forward wall 72 of the foot pedal 68. The foot member 81 is pivotable between an upward position and a downward position. When the foot member 87 is pivoted from the upward position to the downward position, each of the foot pedals 68 bears against the ground and, in turn, the respective lever 64 engages the riser plate 52 to move the riser plate 52 from the lowered, recessed condition to the raised condition.

A mechanical hydraulic toe jack 91 is in alternate operational communication with the riser plate 52 of one of each of a respective lifter base 35. Each toe jack 91 includes a hydraulic bottle jack 92 disposed within the internal compartment 50 of the respective lifter base 35 A head saddle 94 is disposed atop and in operational communication with the bottle jack 92. An external shaft 95 extends from the bottle jack 92 through a vertically disposed central slot 96 in a respective one of the right side 43 and the left side 45 of the respective lifter base 35 and is in operational communication with the bottle jack 92. A parallelepiped toe saddle 97 is disposed on an external end 98 of the external shaft 95. The toe saddle 97 is moveable between an upper position within the central slot 96 and a lower position within the central slot 96. When the toe saddle 97 is moved from the upper position to the lower position, the external shaft 95 is in operational communication with the hydraulic toe jack 91 to move the head saddle 94 from a raised condition to a lowered condition. When the head saddle 94 is in the raised condition and the alternate lowered condition, the riser plate 52 is in a lifted condition and alternate lowered condition, respectively. The foot jack 60 and the toe jack 91 are alternately configured to lift and alternately lower the riser plate 52 of the respective lifter base 35.

What is claimed is:

1. A vehicle lift comprising:

a pair of parallel tire ramps, each tire ramp having a front end, a rear end, a top side, a bottom side, a pair of continuous outer sides, and a vertical lip continuously disposed on an upper side of each of the outer sides;

a lifter base disposed on the front end of each tire ramp, the lifter base comprising a lower side, a substantially open front side having a perimeter-disposed frame and a central opening, a rear side, a right side, a left side, and an upper side, a central aperture disposed within the upper side, an internal compartment continuously disposed between the lower side, the front side, the rear side, the right side, the left side, and the upper side, and a concave riser plate engaging the central aperture, the riser plate being disposed within the central aperture in a position parallel to the lifter base lower side when the riser plate is in a lowered, recessed condition, the riser plate being disposed outside of the central aperture parallel to the lifter base lower side when the riser plate is in an alternate raised condition, the riser plate having a recessed receptacle 55 sized to receive a tire therein and a protruding outer edge engaging the upper side of the lifter base when the riser plate is in the lowered, recessed condition;

a manually operated mechanical foot jack in operational communication with the riser plate of each lifter base and with each other, each manual foot jack comprising:

a footer disposed on the lower side within the internal compartment of the respective lifter base;

a lever disposed atop the footer, the lever having a bar extending through the front side of the lifter base;

a parallelepiped foot pedal disposed on an exterior end of the bar, each foot pedal having a forward wall;

a crossbeam having a pair of outer ends, the crossbeam further having a parallelepiped foot member disposed thereon substantially midway between the lifter bases, the foot member having a right wall and a left wall and an arm extending from a respective one of the right wall and the left wall to the crossbeam, the foot member being disposed on a same side of the crossbeam as the forward wall of the foot pedal, the foot member being pivotable between an upward position and a downward position, wherein when the foot member is pivoted from the upward position to the downward position, each of the foot pedals simultaneously bears against the ground;

wherein when each of the foot pedals bears against the ground, the respective lever engages the riser plate to move the riser plate from the lowered, recessed condition to the raised condition;

a mechanical hydraulic toe jack in alternate operational communication with the riser plate of one of each of a respective lifter base, each toe jack comprising:

a hydraulic bottle jack disposed within the internal compartment of the respective lifter base;

a head saddle disposed atop and in operational communication with the bottle jack;

an external shaft extending from the bottle jack through a vertically disposed central slot in a respective one of the right side and the left side of the respective lifter base, the external shaft in operational communication with the bottle jack; and a parallelepiped toe saddle disposed on an external end of the external shaft, wherein the toe saddle is moveable between an upper position within the central slot and a lower position within the central slot;

wherein when the toe saddle is moved from the upper position to the lower position, the external shaft is in operational communication with the hydraulic toe jack to move the head saddle from a raised condition to a lowered condition;

wherein when the head saddle is in the raised condition and the alternate lowered condition, the riser plate is in a lifted condition and alternate dropped condition, respectively; and wherein the foot jack and the toe jack are alternately configured to lift and alternately lower the riser plate of the respective lifter base.

2. The vehicle lift of claim 1 further comprising:

an openable lid of each foot pedal;

an interior cavity of each foot pedal;

a notch disposed on an internal side of each foot pedal, the notch open on a top edge of the foot pedal;

a parallelepiped attachment member disposed on each of the outer ends of the crossbeam;

wherein each outer end of the crossbeam engages the notch of the respective foot pedal; and wherein each attachment member securingly engages the interior cavity of the respective foot pedal.

3. The vehicle lift of claim 1 wherein the top side of each of the tire ramps has a gripping texture.

4. A vehicle lift comprising:

a pair of parallel tire ramps, each tire ramp having a front end, a rear end, a top side, a bottom side, a pair of continuous outer sides, an a vertical lip continuously disposed on an upper side of each of the outer sides;

a lifter base disposed on the front end of each tire ramp, the lifter base comprising a lower side, a substantially open front side having a perimeter-disposed frame and a central opening, a rear side, a right side, a left side, and an upper side, a central aperture disposed within the upper side, an internal compartment continuously disposed between the lower side, the front side, the rear side, the right side, the left side, and the upper side, and a concave riser plate engaging the central aperture, the riser plate being disposed within the central aperture in a position parallel to the lifter base lower side when the riser plate is in a lowered, recessed condition, the riser plate being disposed outside of the central aperture parallel to the lifter base lower side when the riser plate is in an alternate raised condition, the riser plate having a recessed receptacle sized to receive a tire therein and a protruding outer edge engaging the upper side of the lifter base when the riser plate is in the lowered, recessed condition;

a manually operated mechanical foot jack in operational communication with the riser plate of each lifter base and with each other, each manual foot jack comprising:

a footer disposed on the lower side within the internal compartment of the respective lifter base;

a lever disposed atop the footer, the lever having a bar extending through the front side of the lifter base;

a parallelepiped foot pedal disposed on an exterior end of the bar, each foot pedal having a forward wall;

a crossbeam having a pair of outer ends, the crossbeam further having a parallelepiped foot member disposed thereon substantially midway between the lifter bases, each of the foot members having a right wall and a left wall and an arm extending from one of the right wall and the left wall to the crossbeam, the foot member being disposed on a same side of the crossbeam as the forward wall of the foot pedal, the foot member being pivotable between an upward position and a downward position, wherein when the foot member is pivoted from the upward position to the downward position, each of the foot pedals bears against the ground;

wherein when each of the foot pedals bears against the ground, the respective lever engages the riser plate to move the riser plate from the lowered, recessed condition to the raised condition;

a mechanical hydraulic toe jack in alternate operational communication with the riser plate of one of each of a respective lifter base, each toe jack comprising:

a hydraulic bottle jack disposed within the internal compartment of the respective lifter base;

a head saddle disposed atop and in operational communication with the bottle jack;

an external shaft extending from the bottle jack through a vertically disposed central slot in a respective one of the right side and the left side of the respective lifter base, the external shaft in operational communication with the bottle jack;

a parallelepiped toe saddle disposed on an external end of the external shaft, wherein the toe saddle is moveable between an upper position within the central slot and a lower position within the central slot;

wherein when the toe saddle is moved from the upper position to the lower position, the external shaft is in operational communication with the hydraulic toe jack to move the head saddle from a raised condition to a lowered condition;

wherein when the head saddle is in the raised condition and the alternate lowered condition, the riser plate is in a lifted condition and alternate dropped condition, respectively;

wherein the foot jack and the toe jack are alternately configured to lift and alternately lower the riser plate of the respective lifter base;

an openable lid of each foot pedal;

an interior cavity of each foot pedal;

a notch disposed on an internal side of each foot pedal, the notch open on a top edge of the foot pedal; and a parallelepiped attachment member disposed on each of the outer ends of the crossbeam;

wherein each outer end of the crossbeam engages the notch of the respective foot pedal;

wherein each attachment member securingly engages the interior cavity of the respective foot pedal; and wherein the top side of each of the tire ramps has a gripping texture.

* * * * *